United States Patent [19]

Tokuno et al.

[11] Patent Number: 4,684,360

[45] Date of Patent: Aug. 4, 1987

[54] TOOL POSITIONING DEVICE

[75] Inventors: Masateru Tokuno, Nishinomiya; Tetsuya Sawada, Kyoto, both of Japan

[73] Assignee: Rengo Co., Ltd., Osaka, Japan

[21] Appl. No.: 828,917

[22] Filed: Feb. 13, 1986

[30] Foreign Application Priority Data

Feb. 14, 1985 [JP] Japan ..... 60-28092

[51] Int. Cl.[4] ..... B05B 1/14

[52] U.S. Cl. ..... 493/367; 493/365; 493/370; 493/475; 83/425.4; 83/498; 83/499; 83/504

[58] Field of Search ..... 493/361, 365, 366, 367, 493/370, 475; 83/425.4, 498, 499, 504, 508.2

[56] References Cited

U.S. PATENT DOCUMENTS

| | | | |
|---|---|---|---|
| 1,143,187 | 6/1915 | Green | 83/498 |
| 4,516,454 | 5/1985 | Mosburger | 83/504 |
| 4,548,109 | 10/1985 | Tokuno et al. | 83/499 |

*Primary Examiner*—Frederick R. Schmidt
*Assistant Examiner*—Robert Showalter
*Attorney, Agent, or Firm*—Armstrong, Nikaido, Marmelstein & Kubovcik

[57] ABSTRACT

A device for positioning tools such as slitters and scorers used with a corrugating machine is proposed. As a pair of rotary shafts rotate, tool heads mounted thereon and each carrying a tool rotate, so that the tools work the web of corrugated fiberboard fed between them as required. When a transfer unit is operated with the tool head supporting plate coupled with the position adjusting member carrying a tool head, they move together axially along the rotary shafts, so that a pair of the tools will be moved simultaneously to a desired position.

13 Claims, 8 Drawing Figures

TOOL POSITIONING DEVICE

The present invention relates to a device for positioning tools for slitting or scoring a web material such as corrugated fiberboard.

On a corrugating machine for manufacturing corrugating fiberboard, a plurality of slitters are arranged in the direction of the width of the web of corrugated fiberboard to slit it to required widths and a plurality of scorers are arranged downstream of the slitters in the direction of the width of the web to form a required number of scores in the corrugated fiberboard. Both the slitters and the scorers are supported so as to be movable transversely because their position has to be adjusted in the direction of the width of the web according to the width of corrugated fiberboard. The position of each tool is adapted to be adjusted separately by means of a tool positioning device.

A prior art device for positioning slitters and scorers (hereinafter referred to as "tools") is disclosed in Japanese Patent Publication No. 57-34091 filed by the assignee of the present invention. The prior art device comprises a pair of rotary shafts, a plurality of tool holders axially slidably mounted on the rotary shafts and each formed with a groove in their outer periphery, and shifters adapted to be engaged and disengaged in and from the groove formed in each of the tool holders and to be movable along the rotary shafts for moving the tool holders and thus the tools along the rotary shafts.

The conventional tool positioning device requires means for moving the shifters separately along the rotary shafts and means for moving all the shifters into and out of engagement in the grooves in the respective tool holders. This makes the mechanism very complicated and bulky. Secondly, since the shifters are arranged in such a position as not to obstruct the feeding of the web, the tools have to be moved toward the shifters for adjustment of the position of tools. This makes complicated the structure for supporting the rotary shafts on which the tools are mounted. Also, means for moving the rotary shafts carrying the tools is additionally required.

An object of the present invention is to provide an improved tool positioning device which is simpler in construction and obviates the abovesaid shortcomings.

In accordance with the present invention, there is provided a tool positioning device for positioning a plurality of tools for working a running web, the device comprising; a pair of rotary shafts arranged one over the other so as to be parallel to each other and to be perpendicular to the direction in which the web runs; a plurality of tool heads mounted on each of the rotary shafts so as to be slidable axially thereon and turn together with the rotary shaft; the tool heads each being adapted to carry one of the tools; a plurality of head supporting plates for supporting the tool heads mounted on one of the rotary shafts so as to allow the tool heads to turn together with the respective rotary shafts; a plurality of position adjusting members for supporting the tool heads mounted on the other of the rotary shafts so as to allow the tool heads to turn together with the other of the rotary shafts; a transfer means for moving the position adjusting members independently along the rotary shaft; and a plurality of coupling means each for coupling together an opposed pair formed by one of the head supporting plates and one of the position adjusting members, so that the opposed pair will be moved together by the transfer means along the rotary shafts.

On the tool positioning device of the present invention, as the pair of rotary shafts rotate, the tool heads mounted thereon and each carrying a tool rotate, so that the tools will work the web fed between them as required. With the rotary shafts stopped and the head supporting plate coupled with the position adjusting member, when the transfer unit is operated, the head supporting plate and the position adjusting member move together axially along the rotary shafts. Since they each carry a tool head and the tool head carries a tool, a pair of the tools can be adjusted simultaneously to a desired position.

Other objects and advantages of the present invention will become apparent from the following description taken with reference to the accompanying drawings, in which.

Figure 1:
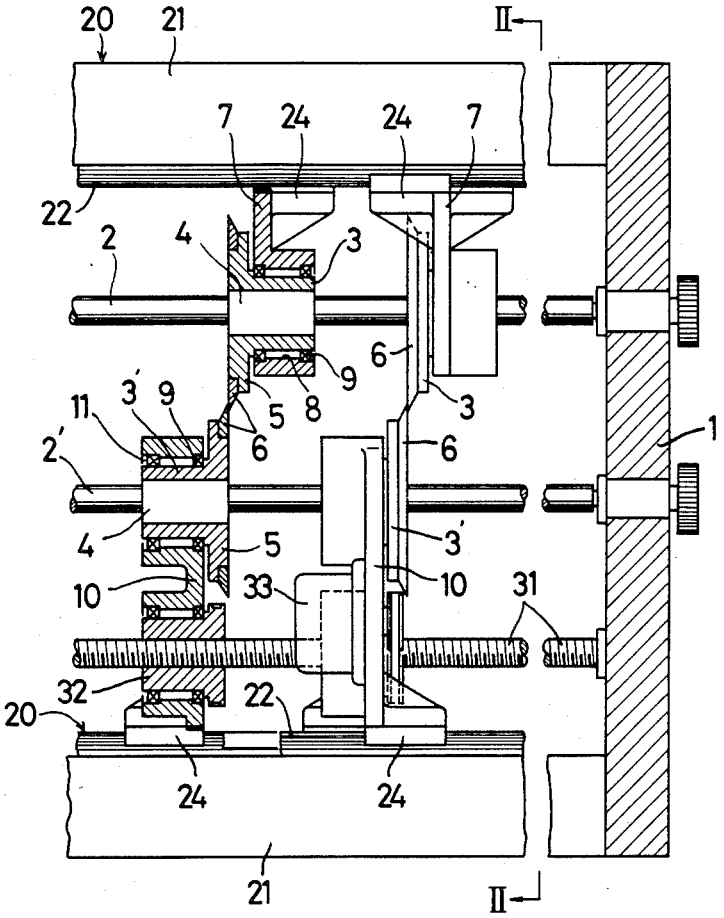
FIG. 1 is a vertical sectional front view of a portion of an embodiment of the present invention.
Figure 2:
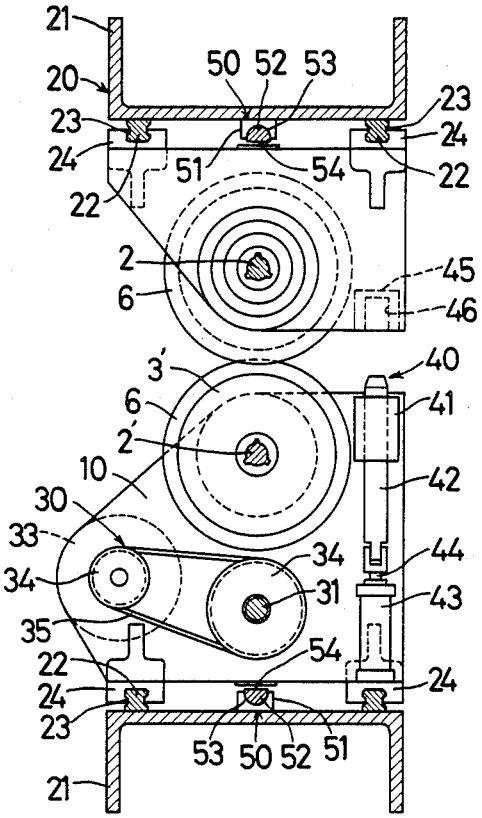
FIG. 2 is a sectional view taken along the line II—II of FIG. 1.
Figure 3:
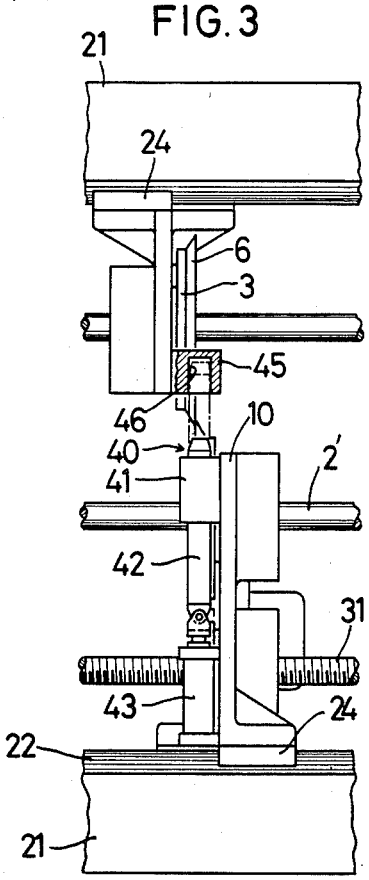
FIG. 3 is a partially cutaway rear view of a portion of the same.

Referring to FIGS. 1–3, a pair of rotary shafts 2, 2' arranged one over the other and in parallel to each other are spline shafts and have their both ends supported by side frames 1. A plurality of tubular tool heads 3, 3' are mounted on the rotary shafts 2, 2', respectively. Each tool head 3, 3' is provided with a spline bearing 4 in its inside so as to be axially slidable and not rotatable with respect to the rotary shaft 2 or 2'. Each tool head 3, 3' is also formed with a flange 5 at its one end to carry a circular tool 6 on one side of the flange 5.

Each tool head 3 mounted on the upper rotary shaft 2 is received in a hole 8 formed in a head supporting plate 7. A bearing 9 provided in the hole 8 prevents the rotation of the tool head 3 from being transmitted to the head supporting plate 7. Each tool head 3' supported on the lower rotary shaft 2' is received in a hole 11 formed in a position adjusting member 10. A bearing 9 provided in the hole 11 prevents the rotation of the tool head 3' from being transmitted to the position adjusting member 10.

The head supporting plates 7 and the position adjusting members 10 are movable axially and along the rotary shafts 2, 2', respectively, by means of a respective guide unit 20, and are prevented from turning. The upper guide unit 20 is disposed over the upper rotary shaft 2 and the lower guide unit 20 is disposed under the lower rotary shaft 2'. Each guide unit 20 comprises a slide beam 21 arranged in parallel to the rotary shaft 2 (or 2'), and a pair of slide rails 22 (FIG. 2) secured to the bottom of the upper slide beam 21 (or to the top of the lower slide beam 21). Linear bearings 24 are secured to the top of the head supporting plate 7 (or to the bottom of the position adjusting member 10) so as to roll in raceway grooves 23 formed in each slide rail 22.

The position adjusting members 10 are moved by a transfer unit 30 along the lower rotary shaft 2'. The transfer unit 30 shown in FIGS. 1–3 comprises a threaded shaft 31 disposed under the lower rotary shaft 2' and in parallel to it, a nut 32 rotatably mounted on each of the position adjusting members 10 and threadedly engaging the threaded shaft 31, a driving motor 33 mounted on the position adjusting member 10 for driving the nut 32, geared pulleys 34 mounted on the nut 32 and on the shaft of the motor 33, and an endless geared belt 35 passing around the pair of geared pulleys 34. (FIG. 2)

The position adjusting member 10 and the head supporting plate 7 opposed thereto are coupled together by a coupling unit 40 when adjusting the position of the tools. After the adjustment of position, they are retained at the adjusted position by their respective retaining unit 50.

The coupling unit 40 comprises a guide tube 41 secured to one side of each position adjusting member 10, a coupling rod 42 slidably received in the guide tube 41, a cylinder 43 having a piston rod 44 coupled to the coupling rod 42. The tip of the coupling rod 42 is adapted to be engaged in a hole 46 formed in a projection 45 provided on the side of the head supporting plate 7 just over the coupling rod 42.

The retaining unit 50 is of the structure described below. The retaining unit 50 for the head supporting plate 7 is of the same structure as the retaining unit 50 for the position adjusting member 10. Thus, we shall described only the latter. For both of the retaining units, the same numerals are used to designate the same parts.

The retaining unit 50 comprises a bearing 51 secured to the slide beam 21, and a cam shaft 52 rotatably supported on the bearing 51 so as to be parallel to the slide rails 22, so that a plurality of the position adjusting members 10 can be retained by a single retaining unit 50 at a time. The cam shaft 52 is formed on its outer periphery with a semi-circular pressing portion 53 and a flat non-pressing portion 54. As the cam shaft 52 turns, the pressing portion 53 engages the position adjusting member 10 on its bottom center, forcibly pushing it up. This eliminates any play between the linear bearings 24 and the slide rails 22, so that the member 10 will be retained in position.

The retaining unit may be of any other structure. Instead of the cam shaft 52, an inflatable elastic tube may be used which can be inflated by supplying air thereinto to press it against the position adjusting member 10. Another example of the retaining unit will be described later with reference to FIGS. 6 and 7.

The tool positioning device shown in FIGS. 1–3 is of the structure as described above, and is designed to adjust the position of the tools 6 and retain them in position. A web material fed to between pairs of the tools 6 is worked as the tools rotate in opposite directions.

In operation, the retaining units 50 are firstly operated to release the head supporting plate 7 and the position adjusting member 10, and the coupling rod 42 of the coupling unit 40 is moved to bring its tip into the hole 46 in the projection 45 on the head supporting plate 7. Now, the position adjusting member 10 is coupled with the head supporting plate 7. In this state, the motor 33 is started. Since the threaded shaft 31 is fixed, the nut 32 turns around the threaded shaft, moving axially. Thus, the position adjusting member 10 and the head supporting plate 7 coupled thereto move axially along the rotary shafts 2 and 2', respectively.

The tool heads 3, 3' carried by the head supporting plate 7 and the position adjusting member 10, respectively, move along the rotary shafts 2, 2', respectively, so that the axial position of the tools 6 mounted on the tool heads 3, 3' will be adjusted.

After the axial position of the tools has been adjusted, the cylinder 43 of the coupling unit 40 is operated to disengage the coupling rod 42 from the hole 46 and the coupling rod 42 is withdrawn not to obstruct the feeding of the web. The retaining units 50 are then operated to retain the head supporting plate 7 and the position adjusting member 10 in their adjusted position. In this state, the rotary shafts 2, 2' are rotated in opposite directions to work the web by means of the tools 6 which turn with rotary shafts 2, 2'.

Although in the embodiment the retaining unit 50 is provided to insure that the tools are retained at the adjusting position, it may be omitted.

Although in the embodiment of FIGS. 1 to 3 the transfer unit 30 comprises the threaded shaft 31, the nut 32 mounted thereon and the motor 33 for driving the nut 32, it may take any other arrangement. For example, as shown in FIGS. 4 and 5, a rack 36 may be provided on the slide beam 21 so as to be parallel to the slide rail 22 and a pinion 37 engaging the rack 36 may be driven by the motor 33.

Figure 8:
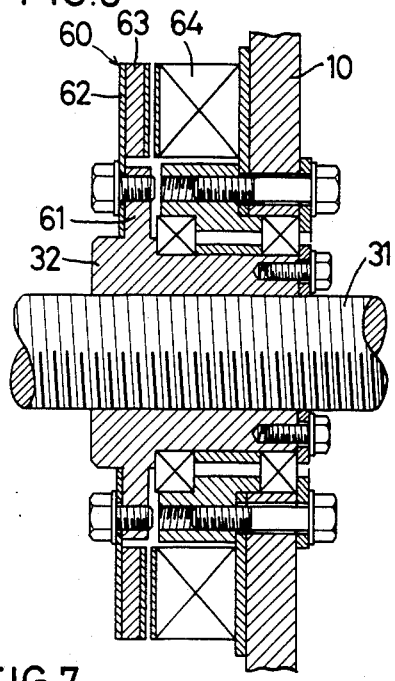
FIG. 8 is a vertical sectional view of another example of the transfer unit used in the present invention.

As shown in FIG. 8, a clutch 60 may be provided to connect and disconnect the position adjusting member 10 to and from the nut 32. When the clutch 60 is on, the position adjusting member 10 is coupled with the nut 32 so that it will be moved along the threaded shaft 31 as the threaded shaft engaging the nut 32 is driven by a motor. (In this embodiment, the threaded shaft is not fixed but can rotate). When the tools are moved to their correct position and the clutch is turned off, the rotation of the nut 32 is not transmitted to the position adjusting member 10. Thus, the tools are retained in the adjusted position.

The clutch 60 may be of any other type. In the embodiment shown in FIG. 8, an annular elastic plate 62 is mounted on an annular projection 61 formed on the outer periphery of the nut 32. A magnetic body 63 is secured to one side of the elastic plate 62. On the other hand, an exciting coil 64 is secured to the position adjusting member 10 so as to be opposed to the magnetic body 63.

Figure 4:
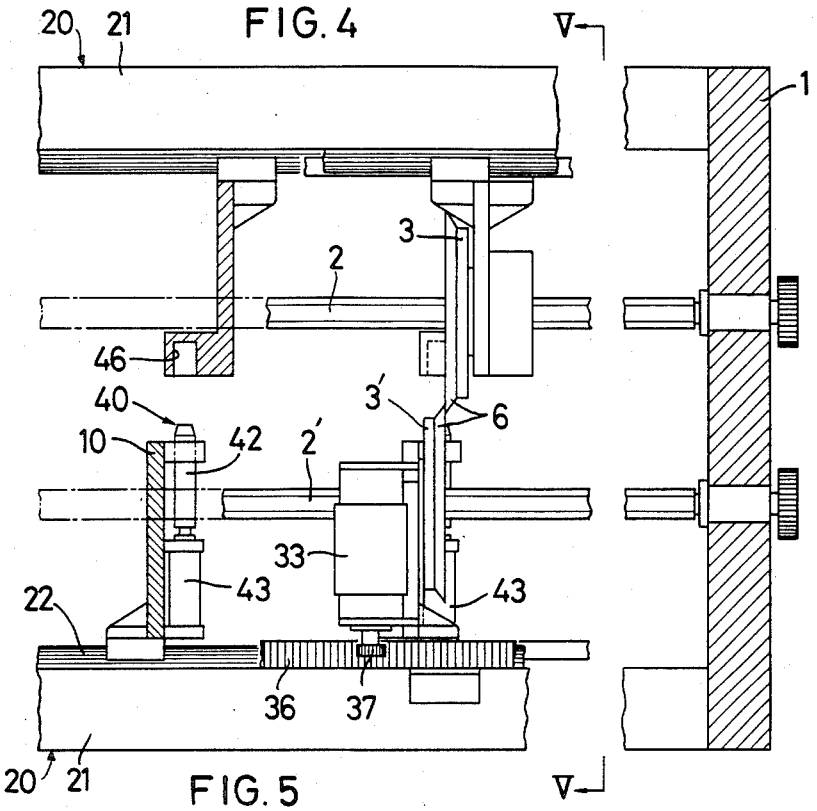
FIG. 4 is a vertical sectional front view of a portion of the second embodiment.
Figure 5:
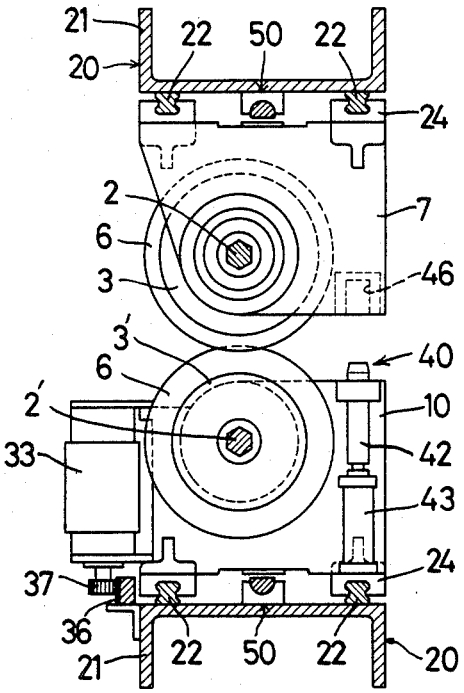
FIG. 5 is a sectional view taken along the line V—V of FIG. 4.
Figure 6:
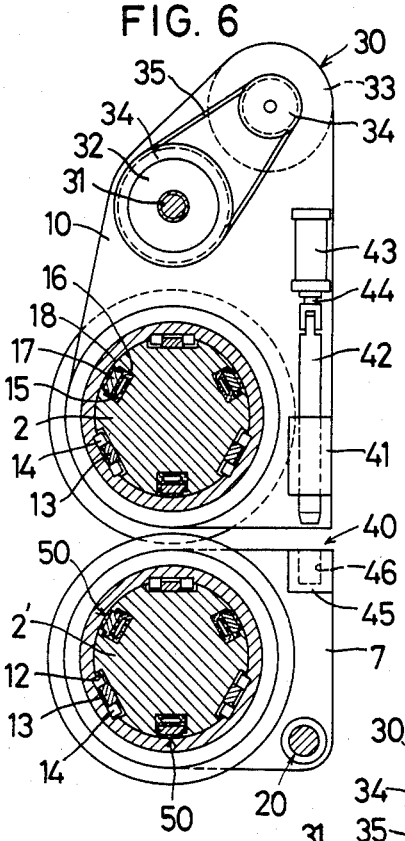
FIG. 6 is a vertical sectional side view of the third embodiment.
Figure 7:
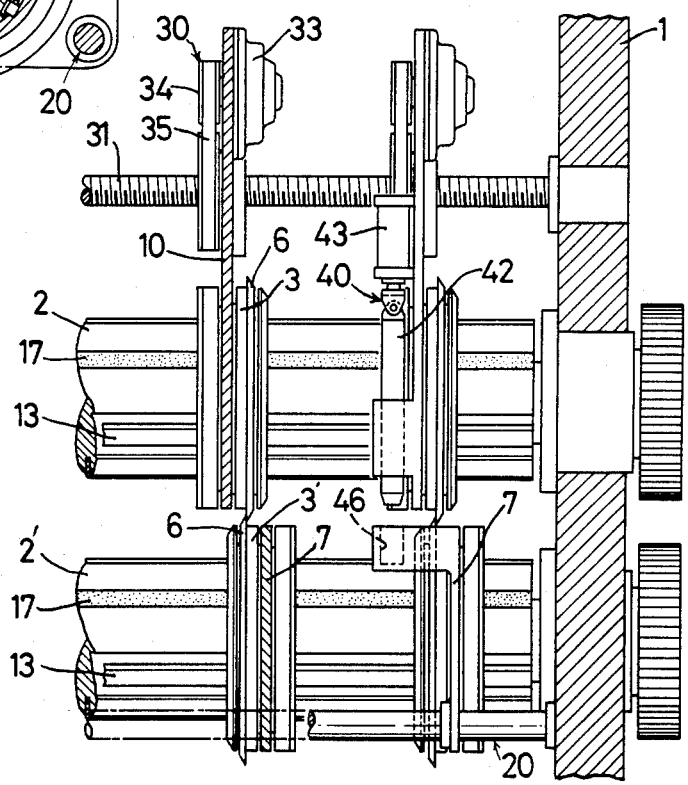
FIG. 7 is a vertical sectional front view of the same.

The rotary shafts 2, 2' may not be spline shafts, but be square shafts as in the embodiment shown in FIGS. 4 and 5, or be round shafts as in the embodiment shown in FIGS. 6 and 7.

In the embodiment of FIGS. 6 and 7, the round rotary shafts 2, 2' are formed in their outer periphery with a plurality of guide grooves 12 at regular spacings so as to be parallel to the axis of the shafts 2, 2'. A slide rail 13 is mounted on the bottom of each guide groove 12 so as to extend axially. Linear bearings 14 are mounted on the inner wall of each tool head 3 (or 3') so as for their balls to roll on the side surfaces of each slide rail 13 so that the tool heads 3, 3' can move axially and along the rotary shafts 2, 2'.

Another example of the retaining unit 50 will be described below.

In the outer wall of the rotary shaft 2, 2', a plurality of container grooves 15 are formed to be disposed between each pair of the adjoining guide grooves 12. In each container groove 15, an inflatable tube 16 and a shoe 17 in the form of a strip are housed, the latter being on the former. Each shoe 17 is prevented from getting out of the groove 15 by the projections 18 provided at each side of the mouth of the groove 15. Air is supplied into the elastic tube 16 to inflate it, thereby pressing the shoe 17 radially outwardly against the inner wall of the tool head 3 (3'). Thus, the tools are retained in the adjusted position.

In the embodiments of FIGS. 6 and 7, the guide unit 20 is provided only for the head supporting plate 7.

Although in the embodiment shown in FIGS. 1–3, each head supporting plate 7 is movable along the upper rotary shaft 2 and each position adjusting member 10 is slidable along the lower rotary shaft 2', the head supporting plate 7 may be associated with the lower rotary shaft 2' and the position adjusting member 10 may be associated with the upper rotary shaft 2, as shown in FIGS. 6 and 7.

Also, the cylinder 43 of the coupling unit 40 may be mounted on the head supporting plate 7 and the projection 45 formed with a hole 46 may be provided on the position adjusting member 10.

Although in any of the embodiments the guide unit 20 should preferably be provided to ensure a smooth movement of the head supporting plate and the position adjusting member in an axial direction, it may be omitted.

In the embodiments of FIGS. 4–7, the coupling unit 40 operates in the same manner as that in the embodiment of FIGS. 1–3.

What we claim:

1. A tool positioning device for positioning a plurality of tools for working a running web, said device comprising;

a pair of rotary shafts arranged one over the other so as to be parallel to each other and to be perpendicular to the direction in which the web runs;

a plurality of tool heads mounted on each of said rotary shafts so as to be slidable axially thereon and turn together with the rotary shaft;

said tool heads each being adapted to carry one of the tools;

a plurality of head supporting plates for supporting said tool heads mounted on one of said rotary shafts so as to allow said tool heads to turn together with said respective rotary shafts;

a plurality of position adjusting members for supporting said tool heads mounted on the other of said rotary shafts so as to allow said tool heads to turn together with said other of the rotary shafts;

a transfer means for moving said position adjusting members independently from said head supporting plates along said rotary shaft; and a plurality of coupling means each for coupling together an opposed pair formed by one of said head supporting plates and one of said position adjusting members, so that said opposed pair will be moved together by said transfer means along said rotary shafts only when said coupling means positively connects said position adjusting means to said head supporting plate.

2. A tool positioning device as claimed in claim 1, further comprising a retaining means for retaining said position adjusting members and said head supporting plates in their adjusted position.

3. A tool positioning device as claimed in claim 1, further comprising a pair of guide means for guiding said head supporting plates and said position adjusting members, respectively, so as to move smoothly in an axial direction.

4. A tool positioning device for positioning a plurality of tools for working a running web, said device comprising;

a pair of rotary shafts arranged one over the other so as to be parallel to each other and to be perpendicular to the direction in which the web runs;

a plurality of tool heads mounted on each of said rotary shafts so as to be slidable axially thereon and turn together with the rotary shaft;

said tool heads each being adapted to carry one of the tools;

a plurality of head supporting plates for supporting said tool heads mounted on one of said rotary shafts so as to allow said tool heads to turn together with said respective rotary shafts;

a plurality of position adjusting members for supporting said tool heads mounted on the other of said rotary shafts so as to allow said tool heads to turn together with said other of the rotary shafts;

a transfer means for moving said position adjusting members independently along said rotary shaft; and a plurality of coupling means each for coupling together an opposed pair formed by one of said head supporting plates and one of said position adjusting members, so that said opposed pair will be moved together by said transfer means along said rotary shafts, each of said coupling means comprises a guide tube secured to one of said position adjusting member and said head supporting plate, a coupling rod slidably received in said guide tube, and a cylinder having a piston rod coupled to said coupling rod, said coupling rod being adapted to be engaged with the other of said position adjusting member and said head supporting plate.

5. A tool positioning device as claimed in claim 1, wherein said transfer means comprises a fixed threaded shaft arranged parallel to said rotary shafts, a nut rotatably mounted on each of said position adjusting members and threadedly engaging said threaded shaft, and a driving motor for driving said nut.

6. A tool positioning device as claimed in claim 1, wherein said transfer means comprises a rotary threaded shaft arranged parallel to said rotary shafts, a nut mounted on each of said position adjusting members, a driving motor for driving said rotary threaded shaft, and a clutch means for connecting and disconnecting said nut to and from said respective position adjusting member.

7. A tool positioning device as claimed in claim 1, wherein said rotary shafts are spline shafts.

8. A tool positioning device as claimed in claim 1, wherein said rotary shafts are square shafts.

9. A tool positioning device as claimed in claim 1, wherein said rotary shafts are round shafts.

10. A tool positioning device as claimed in claim 4, further comprising a retaining means for retaining said position adjusting members and said head supporting plates in their adjusted position.

11. A tool positioning device as claimed in claim 4, further comprising a pair of guide means for guiding said head supporting plates and said position adjusting members, respectively, so as to move smoothly in an axial direction.

12. A tool positioning device as claimed in claim 4, wherein said transfer means comprises a fixed threaded shaft arranged parallel to said rotary shafts, a nut rotatably mounted on each of said position adjusting members and threadedly engaging said threaded shaft, and a driving motor for driving said nut.

13. A tool positioning device as claimed in claim 4, wherein said rotary shafts are spline shafts.

* * * * *